United States Patent [19]

Makuta et al.

[11] Patent Number: 4,481,852

[45] Date of Patent: Nov. 13, 1984

[54] SOUND GENERATING CIRCUIT FOR TIMEPIECE

[75] Inventors: Shunichi Makuta; Hiroshi Miyasaka, both of Kitakatsushika; Katsuhiko Takebe, Machida, all of Japan

[73] Assignee: Rhythm Watch Company Limited, Tokyo, Japan

[21] Appl. No.: 281,291

[22] Filed: Jul. 7, 1981

[30] Foreign Application Priority Data

| | | | |
|---|---|---|---|
| Jul. 10, 1980 | [JP] | Japan | 55-94775 |
| Jul. 31, 1980 | [JP] | Japan | 55-105249 |
| Aug. 1, 1980 | [JP] | Japan | 55-106530 |
| Aug. 1, 1980 | [JP] | Japan | 55-106531 |

[51] Int. Cl.[3] ..... G10F 1/00

[52] U.S. Cl. ..... 84/1.03; 84/1.24; 340/384 E; 368/272

[58] Field of Search ..... 368/272, 273; 84/1.03, 84/1.01, 1.24; 340/384 E

[56] References Cited

U.S. PATENT DOCUMENTS

| | | | |
|---|---|---|---|
| 4,090,349 | 5/1978 | Takase | 340/384 E |
| 4,205,574 | 6/1980 | Hoskinson et al. | 84/1.03 |
| 4,267,586 | 5/1981 | Uchino et al. | 84/1.03 |
| 4,323,995 | 4/1982 | Chiu | 368/273 |

*Primary Examiner*—Forester W. Isen

*Attorney, Agent, or Firm*—Koda and Androlia

[57] ABSTRACT

A sound generating circuit for a timepiece including a sound base signal generator, a program divider, a dividing ratio selecting counter a sound interval base signal generator and a sound producer, whereby the sounding action of frequencies which repeatedly changes at the sound intervals and cycles is performed and can produce the onomatopoetic sounds of bird chirp, insect churr and the like which feels soft and soothing for the users.

9 Claims, 19 Drawing Figures

| | $B_0$ | $B_1$ | $B_2$ | ---- |
|---|---|---|---|---|
| 0 | 0 | 0 | 0 | |
| 1 | 0 | — | — | |
| 2 | 0 | — | 0 | |
| 3 | 0 | — | 0 | |
| 4 | 0 | — | 0 | |
| 5 | 0 | 0 | 0 | |
| 6 | 0 | 0 | 0 | |
| 7 | 0 | — | — | |
| 8 | 0 | — | 0 | |
| 9 | 0 | — | 0 | |
| A | 0 | — | 0 | |
| B | — | 0 | 0 | |

FIG. 18

FIG. 16

| C | D | E | X |
|---|---|---|---|
| 0 | 0 | 0 | 0 |
| 0 | — | — | 0 |
| — | 0 | — | 0 |
| — | — | 0 | — |

FIG. 17

| C | D | Y | E | X |
|---|---|---|---|---|
| 0 | 0 | 0 | 0 | 0 |
| 0 | — | 0 | — | 0 |
| — | 0 | 0 | 0 | 0 |
| — | — | 0 | — | — |
| 0 | 0 | — | — | 0 |
| 0 | — | — | 0 | — |
| — | 0 | — | 0 | — |
| — | — | — | — | — |

SOUND GENERATING CIRCUIT FOR TIMEPIECE

BACKGROUND OF THE INVENTION

1. Field of the Invention

This invention relates to a sound generating circuit for a timepiece, and more particularly to a sound generating circuit which can produce onomatopoetic sounds of birds and insects such as crickets, "bell ring" insects, etc.

2. Prior Art

A timepiece having sound mechanism is well known, and is utilized as an alarm clock or time signalling timepiece. In such prior art device, an alarming action or time signalling action has been performed by buzzer or hammering stick bells. In the recent electronic timepiece, an electronic circuit has been used for the sound mechanism, and the alarming or time signalling sounds are formed with chime or the like.

In the prior art devices, however, such sounding action is not always provided with pleasant feelings for the users of the timepiece.

SUMMARY OF THE INVENTION

Accordingly, it is a general object of the present invention to provide a sound generating circuit for a timepiece which can produce onomatopoetic sounds of birds and insects such as crickets, "bell ring" insects, etc. since the birds or the insects hear extremely soft and soothing for human ears.

In keeping with the principles of the present invention, the object is accomplished with a sound generating circuit for a timepiece which includes a sound base signal generator which feeds out sound base signals having a certain frequency, a program divider in which a plurality of different dividing ratios are selected one after another in accordance with a predetermined program to output the above mentioned sound signals at the dividing ratios, a dividing ratio selecting counter which supplies outputs repeatedly counted at certain sound intervals to the program divider as dividing ratio selecting signals, a sound interval base signal generator which supplies sound interval base signals to the dividing ratio selecting counter in order to determine sound intervals, and a sound producer which drives sound elements in accordance with the output of the program divider, whereby performed is sounding action with frequencies which are repeatedly changes at certain sound intervals.

BRIEF DESCRIPTION OF THE DRAWINGS

The above mentioned features and object of the present invention will become more apparent by reference to the following description in conjunction with the accompanying drawings, wherein like referenced numerals denote like elements, in which:

FIG. 16 is a truth table of the half adder in FIG. 15;

FIG. 17 is a truth table of the full adder in FIG. 15;

FIG. 18 is a table showing memory contents in the ROM of FIG. 18; and

DETAILED DESCRIPTION OF THE EMBODIMENTS

Figure 1:
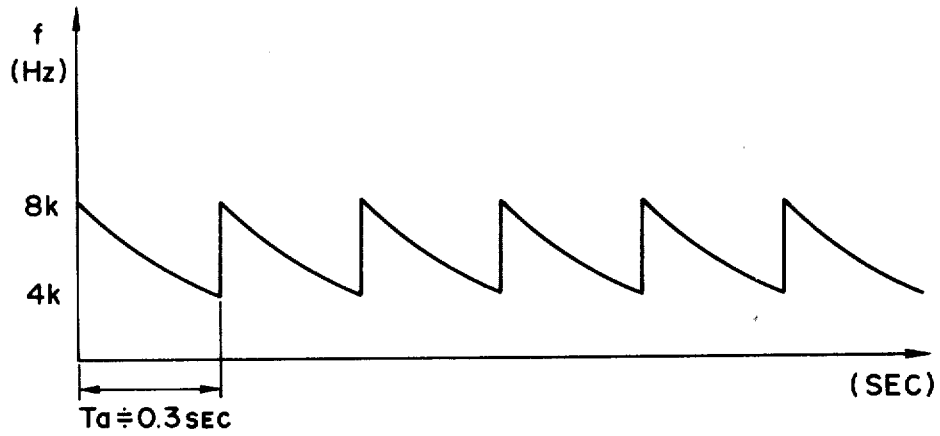
FIG. 1 is a graphic illustration showing model specifications of onomatopoetic sounds which can be obtained by the present invention.

Referring more particularly to the drawings, in FIG. 1 shown therein is a model specifications of bird chirp. Time is taken on the horizontal axis and sound frequency is taken on the vertical axis. As evident from FIG. 1, the onomatopoetic sound of bird chirp shows repeated wave form with certain sound intervals Ta, and the frequency decreases continuously and returns to the initial stage when minimum frequency is reached within each of sound intervals Ta.

Furthermore, it is evident that FIG. 1 shows extremely basic model and the actual bird chirp or insect chirr changes in sound interval cycles in complexity as well as within the sound interval Ta with complicated specifications.

At any rate, the onomatopoetic sound of bird chirp or insect chirr could be obtained from the sounding action having frequencies which repeatedly change at the sound intervals Ta, and soft and soothing sound timepiece could be obtained by means of using such onomatopoetic sounds for alarming sounds or signalling sounds of the timepiece, or background sound of time striking action.

According to the present invention, the sound generating circuit for the timepiece can be offered with the basis of basic theory mentioned above, and first embodiment is shown in FIG. 2.

Figure 2:
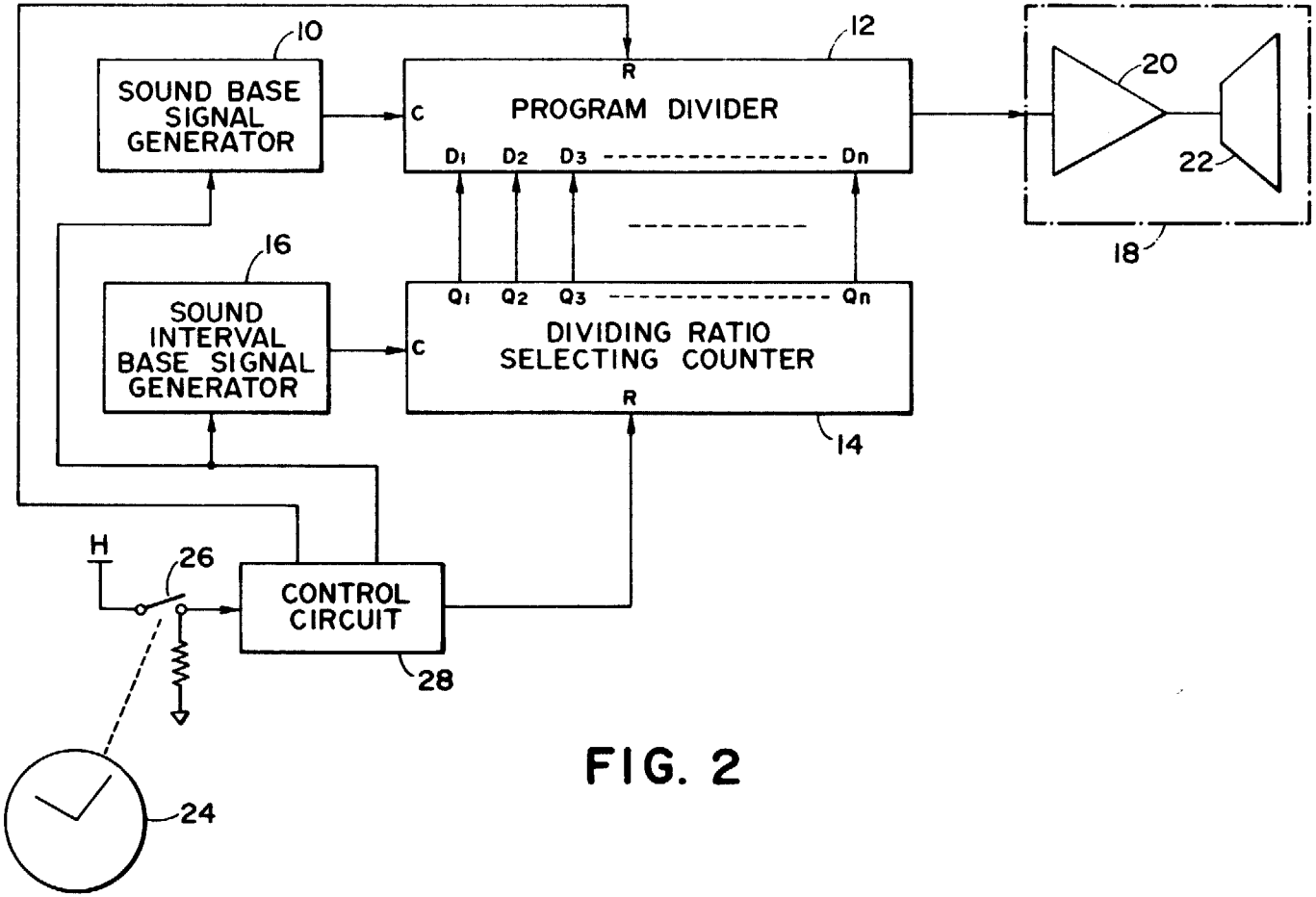
FIG. 2 is a block diagram showing the preferred embodiment of a sound generating circuit for a timepiece in accordance with the teachings of the present invention.

In FIG. 2, a sound base signal generator 10 outputs sound base signals having certain frequencies, and requires to be formed with an oscillator which feeds sound base signals having sufficiently higher frequencies than the highest frequency of the model sound specifications, that is, 8 KHz, in order to obtain such specifications shown in FIG. 1.

The output of the sound base signal generator 10 is supplied to a program divider 12 to divide the sound base signal in accordance with a predetermined program, and the sound signals having changing frequencies are output from the program divider 12. In the embodiment the program divider 12 is formed with a programmable divider in which a dividing ratio can be optionally predetermined and a plurality of different dividing ratios is selected in order in accordance with the predetermined program so that the sound base signals can be divided and output to be supplied to the clock input at the dividing ratio mentioned above.

In order to reset one after another the dividing ratio which is programmed in the program divider 12, Q outputs of a dividing ratio selecting counter 14 is respectively supplied to each of D inputs of the divider 12, and these Q outputs or dividing ratio selecting signals read the dividing ratio corresponding to frequencies which change within the sound interval Ta shown in FIG. 1.

The dividing ratio selecting counter 14 counts in order the sound interval base signals which are supplied to the clock input so that Q outputs or the counted outputs can be output to the program divider 12 as dividing ratio selecting signals, and these counted outputs select the dividing ratio in order. The dividing ratio selecting counter 14 is composed of a ring counter and performs repeated counted action by means of counting the certain numbers of clock input.

In order to supply the sound interval base signals to the clock input of the dividing ratio selecting counter 14, a sound interval base signal generator 16 is prepared, and sound intervals Ta are determined in accordance with the sound interval base signals.

The divided output of the program divider 12 is supplied to a sound producer 18 and sound elements of the sound producer 18 are driven in accordance with the divided output. The sound producer 18 in the embodiment includes an amplifier 20 and a speaker 22 formed with sound elements. The divided output of the program divider 12 is amplified by the amplifier 20 to drive the speaker 22, and the sounding action is performed with frequencies which repeatedly change at sound intervals Ta.

The illustrated first embodiment shows the present invention being used with an alarm clock. An alarm signal is detected from an alarm contact points 26 in a clock mechanism 24, and operates a control circuit 28 to control each of the circuit described above. In other words, from the control circuit 28 reset signals are supplied to the program divider 12 and the dividing ratio selecting counter 14 in ordinary cases, and oscillation stop signals are provided to both of base signal generators 10 and 16. In an on-operation of the alarm contact point 26 in the clock mechanism 24 the control circuit 28 releases the reset signals and the oscillation stop signals to start circuit operations.

The first embodiment of the present invention is composed as mentioned in the above and the action will hereunder be described.

When the indicating time of a timepiece reaches an alarm set time, the alarm contact point 26 is put in the on-state, and the control circuit 28 puts each of the circuits on the on-operation. As a result, the sound base signal generator 10 outputs the sound base signals having a certain frequency, 1 MHz in the embodiment, to the program divider 12. At the same time, from the sound interval base signal generator 16 low frequency sound interval base signals, 380 Hz in the embodiment, is supplied to the dividing ratio selecting counter 14 so that it can start counting the sound interval base signals. This counter 14 is consisted of 7 bit ring counter. In its initial stage, each of the Q outputs shows "0000000", and the program divider 12 feeds the sound signal of maximum frequency, about 4 kHz in the embodiment to the sound producer 18. The dividing ratio selecting counter 14 changes the Q outputs as "1000000" and "0100000" whenever it counts the sound interval base signals, and the program divider 12 selects the dividing ratio which is programmed in accordance with this dividing ratio selecting signals to output the divided sound base signals with the basis of this dividing ratio. In the embodiment, the program divider 12 selects the dividing ratio so that the dividing ratio is increased in order in accordance with the determined program, and the frequency converting action corresponding to the model specifications shown in FIG. 1 is performed within the sound interval Ta.

When the dividing ratio selecting counter 14 counts 27 sound interval base signals, these counted outputs or the dividing ratio selecting signals become "1111111", and the program divider 12 selects the dividing ratio at which the sound base signals are divided into maximum frequency, about 4 kHz in the embodiment. The dividing ratio selecting counter 14 counts up to return to the initial stage and program divider 12 feeds out the second signal at 8 kHz by means of the input from the next sound interval base signal, and continues on the counting action repeatedly.

As mentioned hereinabove, according to the first embodiment, frequencies change repeatedly at the sound intervals Ta of about 300 mili-seconds in accordance with the specifications shown in FIG. 1, and the sound producer 18 performs sounding action in accordance with the sound signals in which the frequencies mentioned above continuously change. Consequently, the users can enjoy onomatopoetic sounds of bird chirp and insect chirr as alarm sounds which can be heard soft and soothing.

Figure 3:
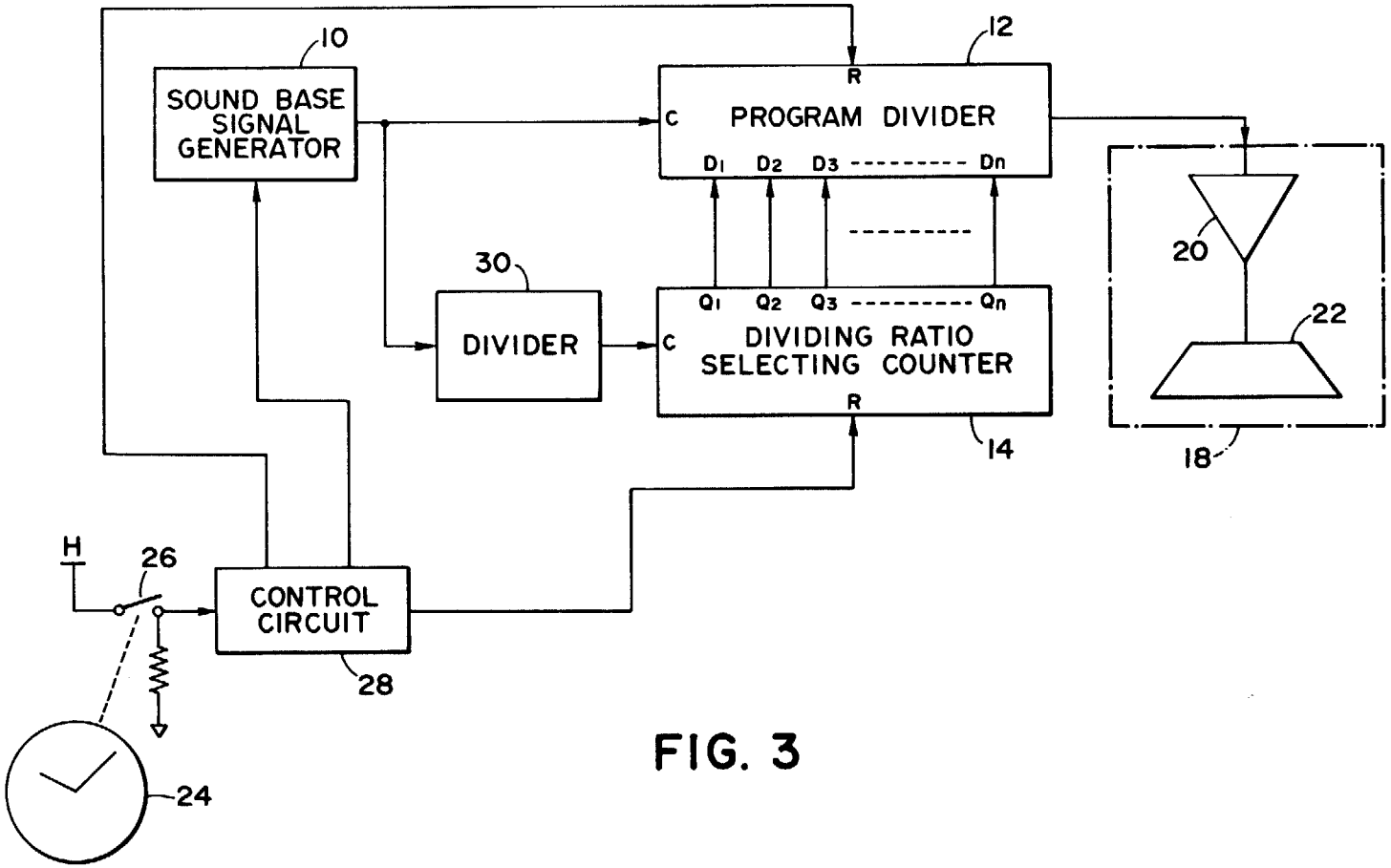
FIG. 3 is a block diagram showing the second embodiment of the present invention.

In FIG. 3 shown therein is the second embodiment, wherein like elements are denoted like referenced numerals with FIG. 2 and the description will be omitted.

In the second embodiment, it is characterized that the sound interval base signal generator is formed with a divider 30 which divides the sound base signals and outputs the sound interval base signals, and is composed of a multi-stage divider to which the sound base signals are supplied from the sound base signal generator 10. Accordingly, no independent oscillator is required as in the first embodiment.

Figure 4:
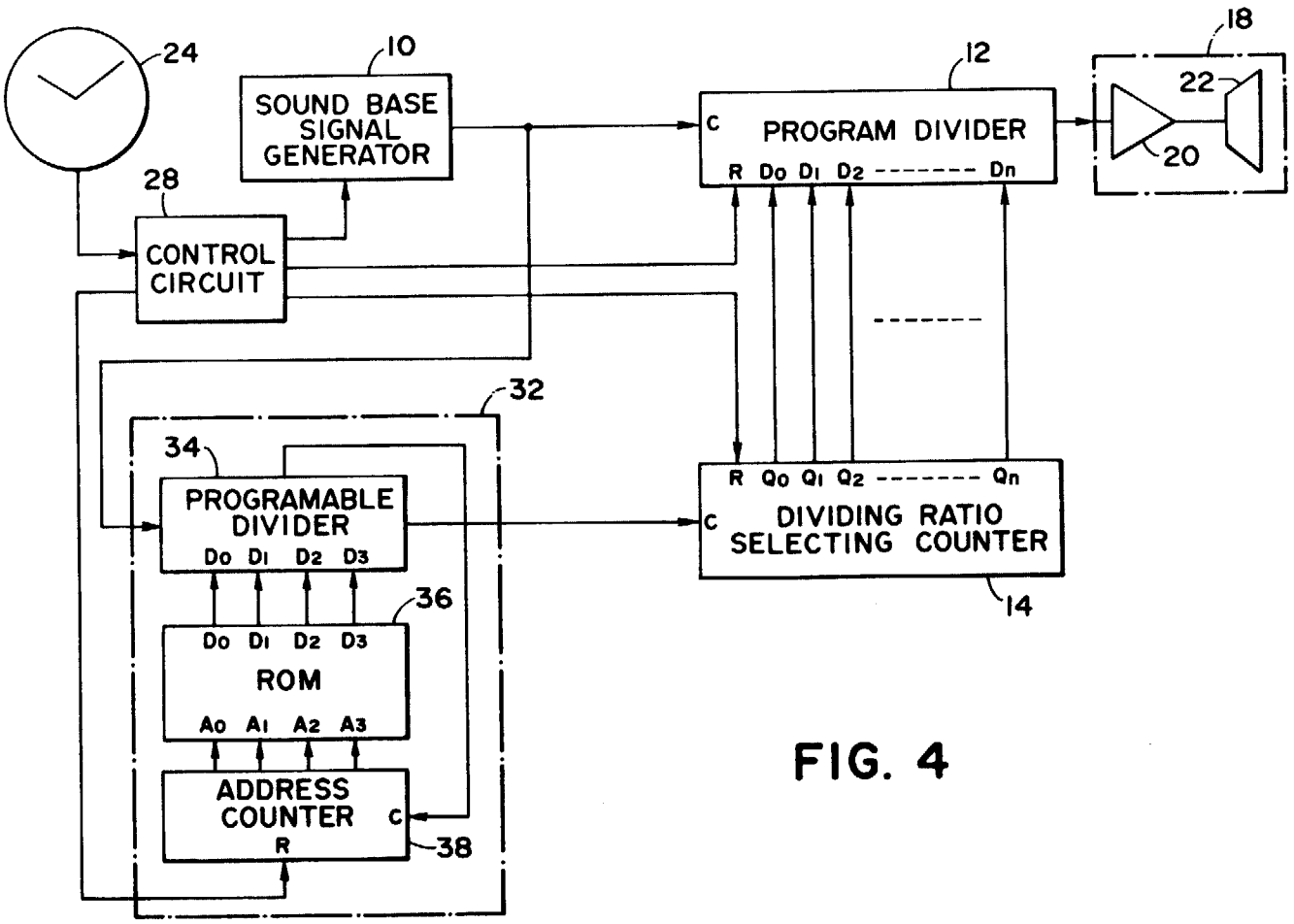
FIG. 4 is a block diagram showing the third embodiment of the present invention.

Furthermore, in FIG. 4 shown therein is the third embodiment, wherein like elements are denoted like referenced numerals with the first embodiment and the description will be omitted.

It is characterized in the third embodiment that the sound interval base signal generator 16 is formed with the sound interval program divider 32 which variably controls the interval of the sound interval base signals in accordance with the predetermined program. The program divider 32 in the embodiment includes a programmable divider 34 which divides the output from the sound base signal generator 10 at the predetermined programmed dividing ratio, a ROM 36 which determines the dividing ratio of the programmable divider 34 mentioned above, and an address counter 38 which addresses the ROM 36. To the clock input of the address counter 38 supplied are the divided low frequency clock signals from the pre-stage of the programmable divider 34, and the ROM 36 is addressed by the address counter 38 so that the output of the ROM 36 selectingly controls the dividing ratio of the programmable divider 34. The divided output of the programmable divider 34 is supplied to the above mentioned dividing ratio selecting counter 14 as the sound interval base signals.

Figure 5:
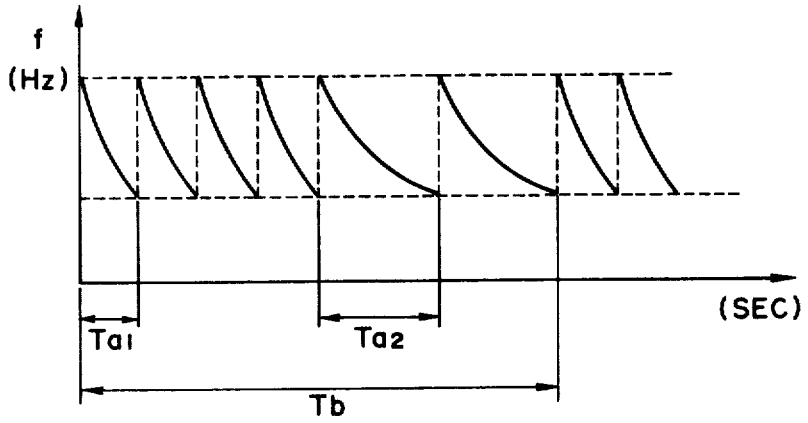
FIG. 5 is a wave form chart showing the sound specifications in FIG. 4.

Accordingly, the counting clock signal intervals change and the repeating cycles or sound intervals Ta can be changed at the predetermined program in accordance with the count-up cycles of the address counter 38. As one example of this is shown in FIG. 5, it is understood that within the repeating cycles Tb (the count-up cycles of the address counter 38) the dividing ratio selecting counter 14 changes as the sound interval Ta1 and Ta2.

Consequently, according to the third embodiment, it becomes possible to obtain onomatopoetic seconds of bird chirp which changes within the repeating cycles Tb in complex and closely as the actual bird chirp.

In the fourth embodiment, the onomatopoetic sounds of bird chirp or insect chirr can be obtained by means of sound action having the frequencies with which repeatedly changes at the varying sound intervals Ta, and a timepiece having soft and soothing sounds can be obtained by means of using such onomatopoetic sounds as alarm sounds, time striking sounds, or background sounds in time striking action.

Figure 6:
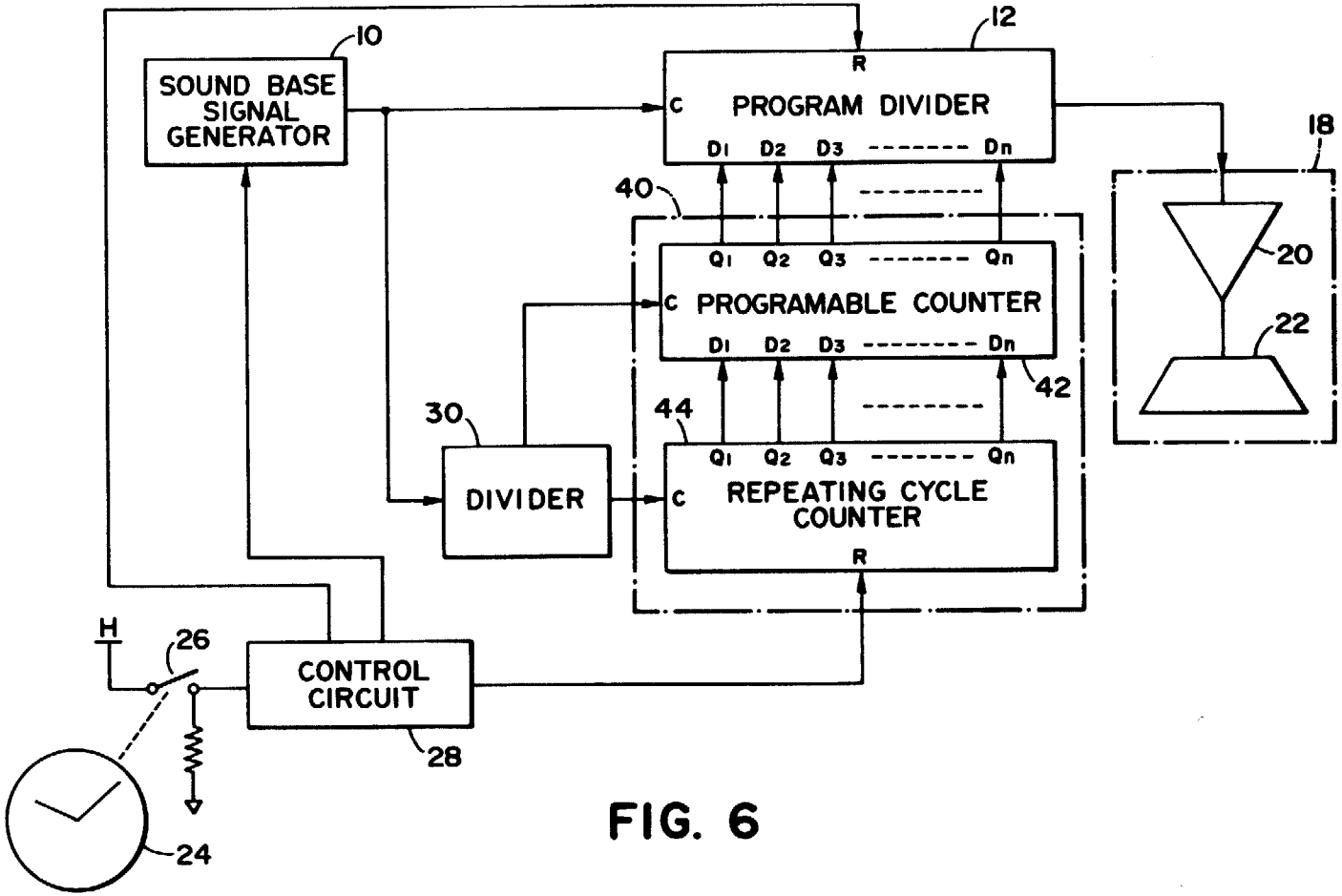
FIG. 6 is a block diagram showing the fourth embodiment of the present invention.

In FIG. 6 shown therein is the preferred fourth embodiment of the present invention, wherein like elements are denoted like referenced numerals with the previous embodiments and the description will be omitted.

The dividing ratio selecting counter 40 in the embodiment includes a programmable counter 42 and a repeating cycle counter 44. The programmable counter 42 performs repeating count action by means of counting the clock input of predetermined numbers. The programmable counter 42 can programmably establish a desired count value of its clock input at a predetermined certain value. The repeating cycle counter 44 is used to read this programmed desired count value. In other words, the repeating cycle counter 44 is also composed of a counter and cyclicly performs counting action by means of counting the certain numbers of clock inputs. The Q output is supplied to D input of the programmable counter 42 mentioned above, and the desired count value of the programmable counter 42 changes in accordance with the repeating cycles of the repeating cycle counter 44 so that the second interval Ta varies at the repeating cycles.

In order to supply first sound interval base signal to the programmable counter 42 and second sound interval base mentioned above, attached in this embodiment is the sound interval base signal generator 30, and the sound intervals Ta and the repeating cycles are determined by first sound interval base signal and second sound interval base signals.

The action of this circuit will hereunder be described.

When the indicating time reaches the alarm set time, the alarm contact points 26 is put in the on-action and the control circuit 28 makes each of the circuits to be on-state. Consequently, a certain frequency of sound base signal, 1 MHz base signal in the embodiment, is output from the sound base signal generator 10 to the program divider 12. At the same time, a low frequency of first sound interval base signals 380 Hz in the embodiment, is supplied from the sound interval base signal generator 30 to the dividing ratio selecting counter 40, and the dividing ratio selecting counter 40 starts to count second sound interval base signals. Since the dividing ratio selecting action within one optional sound interval at the programmable counter 42 is the same with the action in the first embodiment, the description will be omitted.

Figure 7:
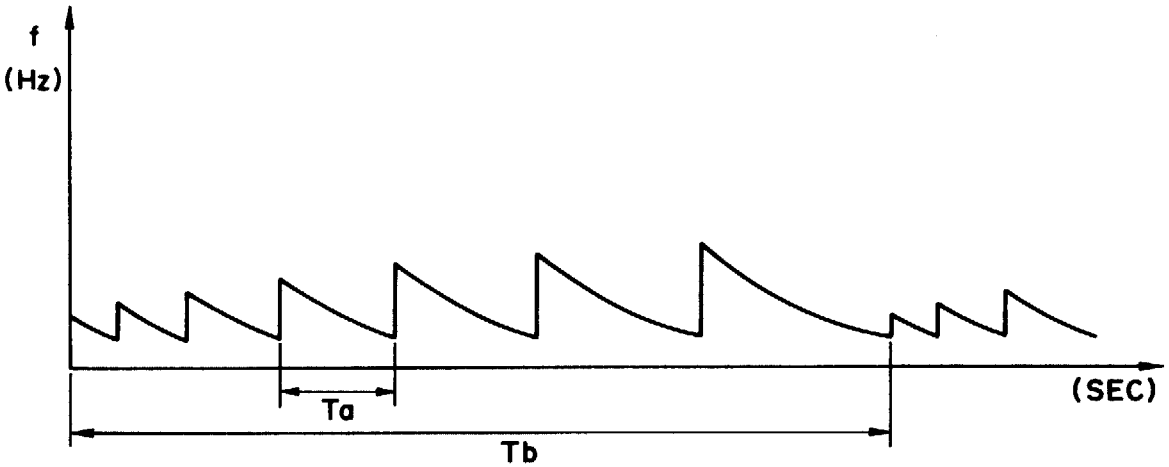
FIG. 7 is a wave form chart showing the sound specifications in FIG. 6.

In this embodiment, it is characterized that the sound intervals Ta of the programmable counter 42 is cyclically varied at the repeating cycles Tb as shown in FIG. 7. In other words, the repeating cycle counter 44 counts second sound interval base signals to count up at the predetermined count value and repeats this action. In counting the signals Q outputs of the counter change the dividing ratio of the programmable counter 42 at the predetermined program so that the sound intervals Ta can be obtained with the cyclic change at repeating cycles Tb. At the same time the maximum frequency also changes at every interval within each of sound intervals Ta, and tones with complicated combination can be advantageously obtained.

Therefore, according to this embodiment, the complicatedly changing frequency characteristics can provide onomatopoetic sounds similar to the actual bird chirp.

Figure 8:
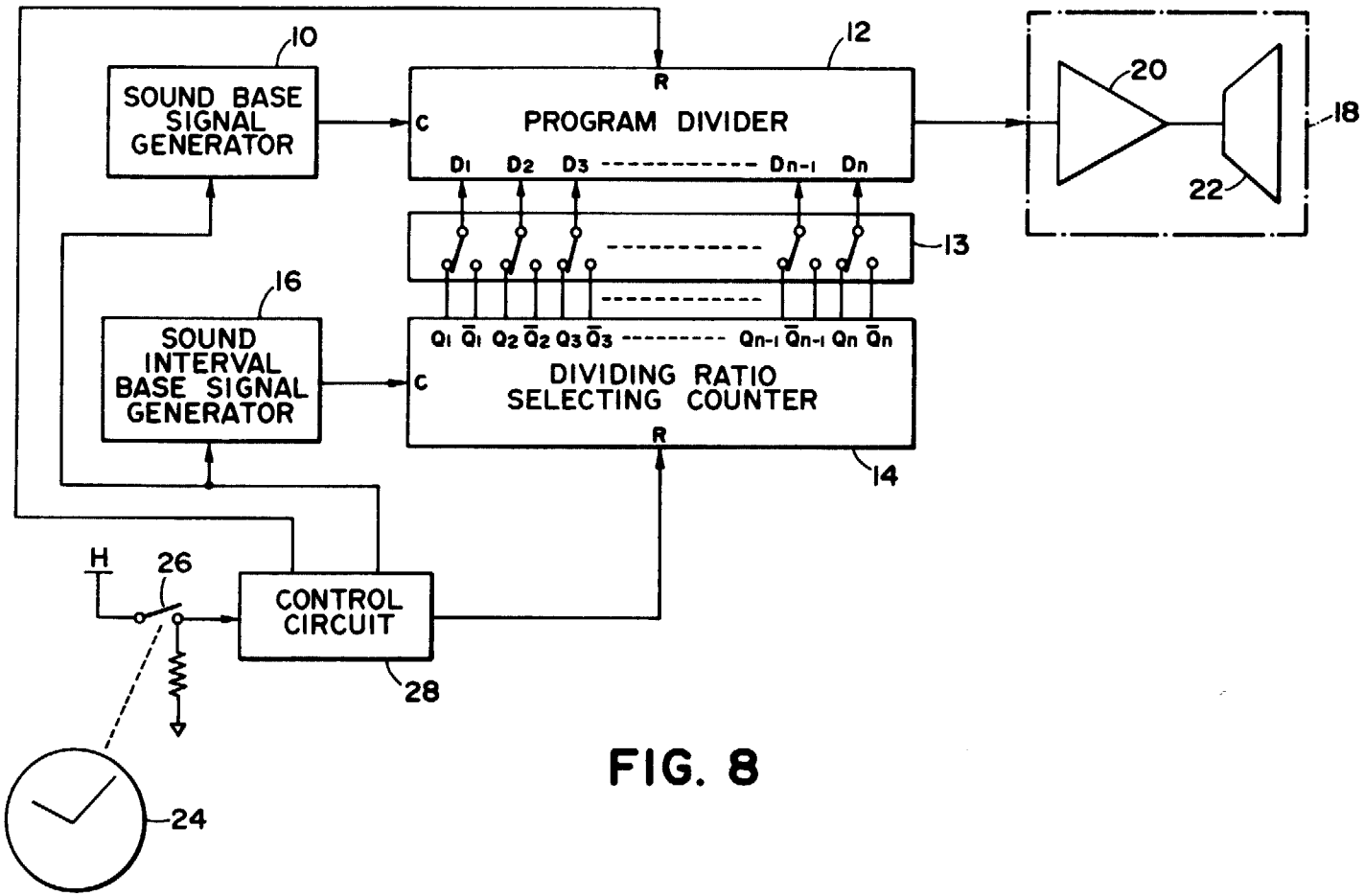
FIG. 8 is a block diagram showing the fifth embodiment of the present invention.

In FIG. 8 shown therein is the fifth embodiment of the present invention, wherein like referenced numerals with the previous embodiments, and the description will be omitted.

In the embodiment, it is characterized that the dividing ratio selecting signals from the dividing ratio selecting counter 14 is supplied to the program divider 12 by way of dividing ratio change over switches 46. In the illustrated embodiment, each switch of the dividing ratio change over switches 46 is connected to each of the D outputs of the program divider 12 by their fixed contact points, and regarding both change over contact points the one is connected to each of the Q outputs of the dividing ratio selecting counter and the other is connected to each of the $\overline{Q}$ outputs. Accordingly, the selective change over of either switch of the dividing ratio change over switches can provide the optionally changed and combined outputs from the dividing ratio selecting counter 14 to the program divider 12 and makes it possible to establish a desired dividing ratio selecting order.

The action of this circuit will be hereunder described.

In such a state that each of the dividing ratio change over switches 46 is switched over to each of the Q output sides, as shown in FIG. 8, the sounding action is performed in the exactly same manner with the first embodiment as shown in characteristics of FIG. 1.

In this embodiment, the change over of the dividing ratio change over switches 46 can optionally establish a dividing ratio selecting order, and makes it possible to have the frequency change within the sound intervals Ta be further complicated change. The simple operation of the change over switches by the users can optionally select and establish different sound characteristics.

Figure 9:
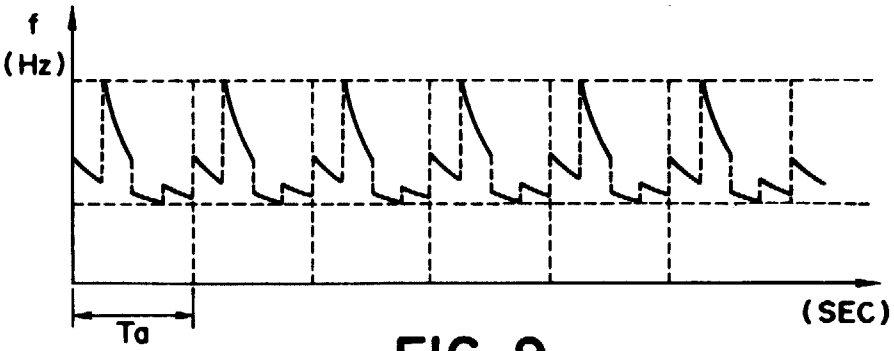
FIG. 9 shows the sound signal specifications of the fifth embodiment.

Modification of the combined outputs of the dividing ratio selecting signals in this embodiment is shown in FIG. 8 as an example in which the switch of the sixth bit $(n-1)$ is changed over from Q output to $\overline{Q}$ output mentioned above. In this case the outputs of the dividing ratio selecting counter 14 are started counting from "0000010", and changed as "1000010", "0100010" and so on. When the 27 members of sound interval base signals are counted, the count output or the dividing ratio selecting signals become "1111101". Accordingly, the wave form chart of the output of the program divider 12 at this change over time becomes as shown in FIG. 9, and the frequency change within each of the sound intervals Ta becomes remarkably complicated in comparison with FIG. 1 so that the sound action can be advantageously obtained with close onomatopoetic sounds to actual bird chirp.

As mentioned heretofore, according to this embodiment, the optional operation of the switch of the dividing ratio change over switches 46 by the users can select the sounding action having complicated frequencies change characteristics and multi-functional sound timepiece can be advantageously obtained.

Figure 10:
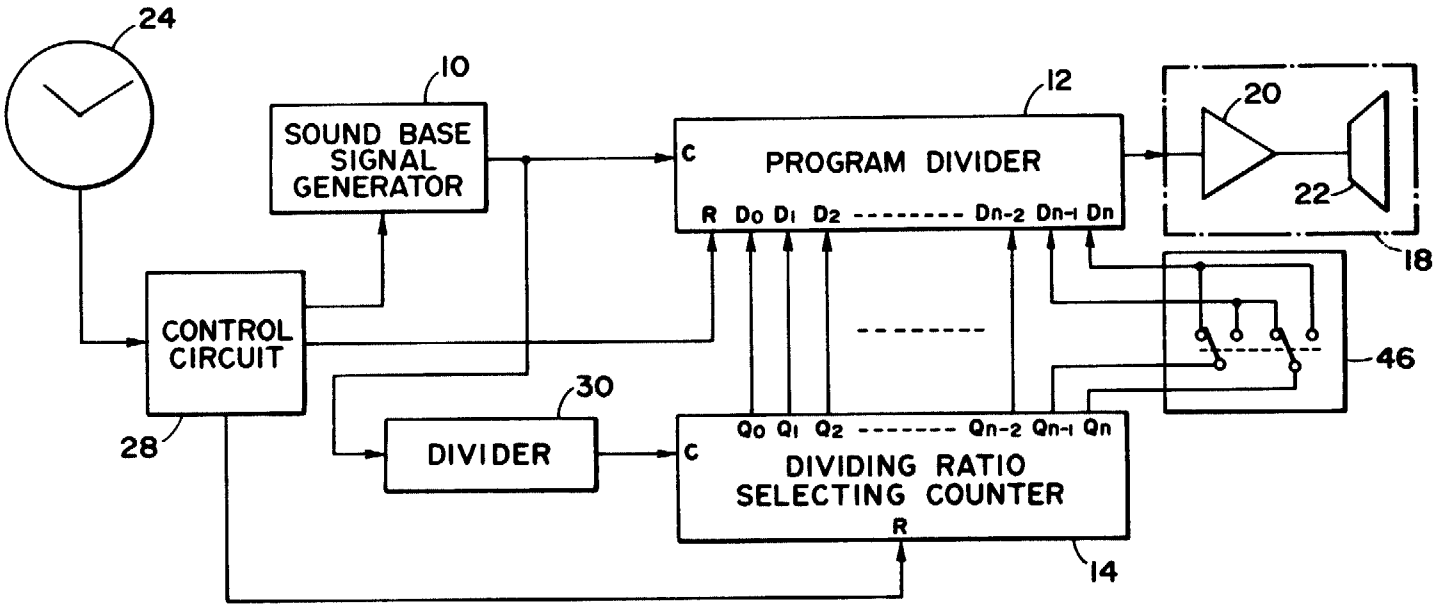
FIG. 10 is a block diagram showing the sixth embodiment of the present invention.

FIG. 10 shows the sixth embodiment of the present invention.

In the sixth embodiment, since the sound interval base signal generator is formed with the divider 30 which divides the sound base signals to output the sound interval base signals and composed of multi-stage divider to which the sound base signals are supplied from the sound base signal generator 10, it is characterized that the independent oscillator as used in the fifth embodiment is not required.

Figure 11:
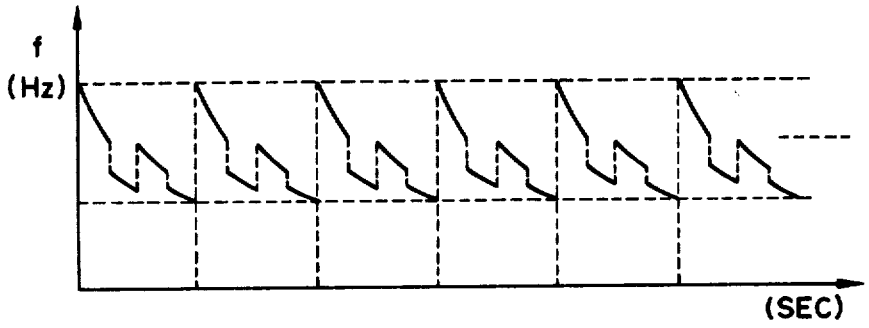
FIG. 11 shows the sound signal specifications of the sixth embodiment.

In the sixth embodiment the dividing ratio change over switches 46 include switches which change over at least two outputs of the dividing ratio selecting counter 14. In the embodiment, the sixth and seventh bit is connected to be able to be changed over, and the change over of the switches can establish a desired dividing ratio selecting order. In FIG. 11 shown therein is the sound signal outputs of the sixth embodiment, and it is understood that it has further complicated wave form which is different from the wave from shown in FIG. 9. It is possible to change over the wave form shown in FIG. 11 to the general wave form shown if FIG. 1.

Figure 12:
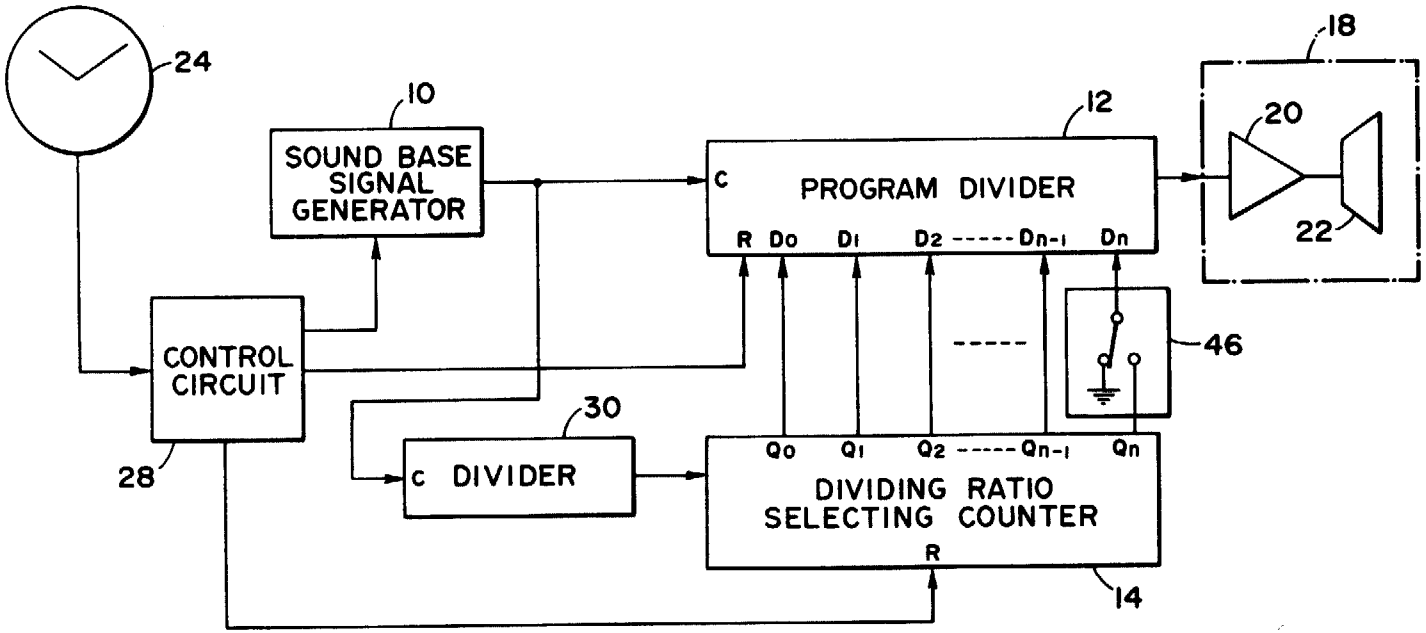
FIG. 12 is a block diagram showing the seventh embodiment of the present invention.

In FIG. 12 shown therein is the seventh embodiments of the present invention, wherein like elements are denoted like referenced numerals with the sixth embodiment and the description will be omitted.

Figure 13:
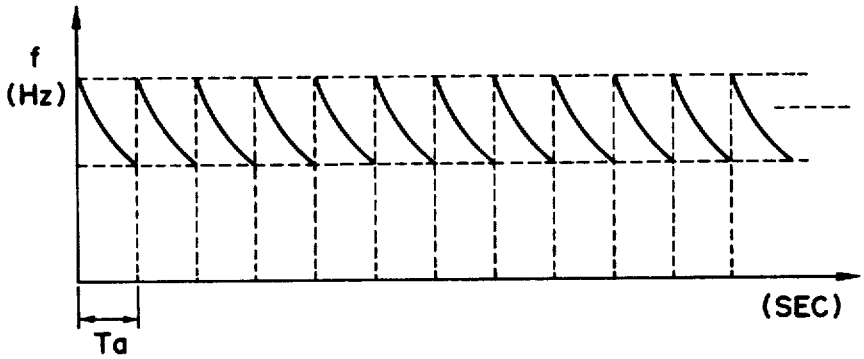
FIG. 13 shows the sound signal specifications of the seventh embodiment.

The dividing ratio change over switch 46 in the seventh embodiment is composed of a switch which changes over the fixed terminal or the grounded terminal in the embodiment and the output of the dividing ratio selecting counter 14 which corresponds with one input of the program divider 12 at least, and the dividing ratio selecting signals of the seventh bit are controlled to be changed over. According to the embodiment, the seventh bit input of the program divider 12 is always put in "0" so that the sound intervals Ta are shortened into half as shown by the wave form chart of FIG. 13 and the sound signals shown in FIGS. 1 and 13 can be selectingly changed over. As evident from FIG. 13, it is characterized that the width of the frequency change gets smaller and the tone of the onomatpoetic sounds can be remarkably changed in this embodiment, since the change over of the switch 46 shortens the sound intervals Ta.

Figure 14:
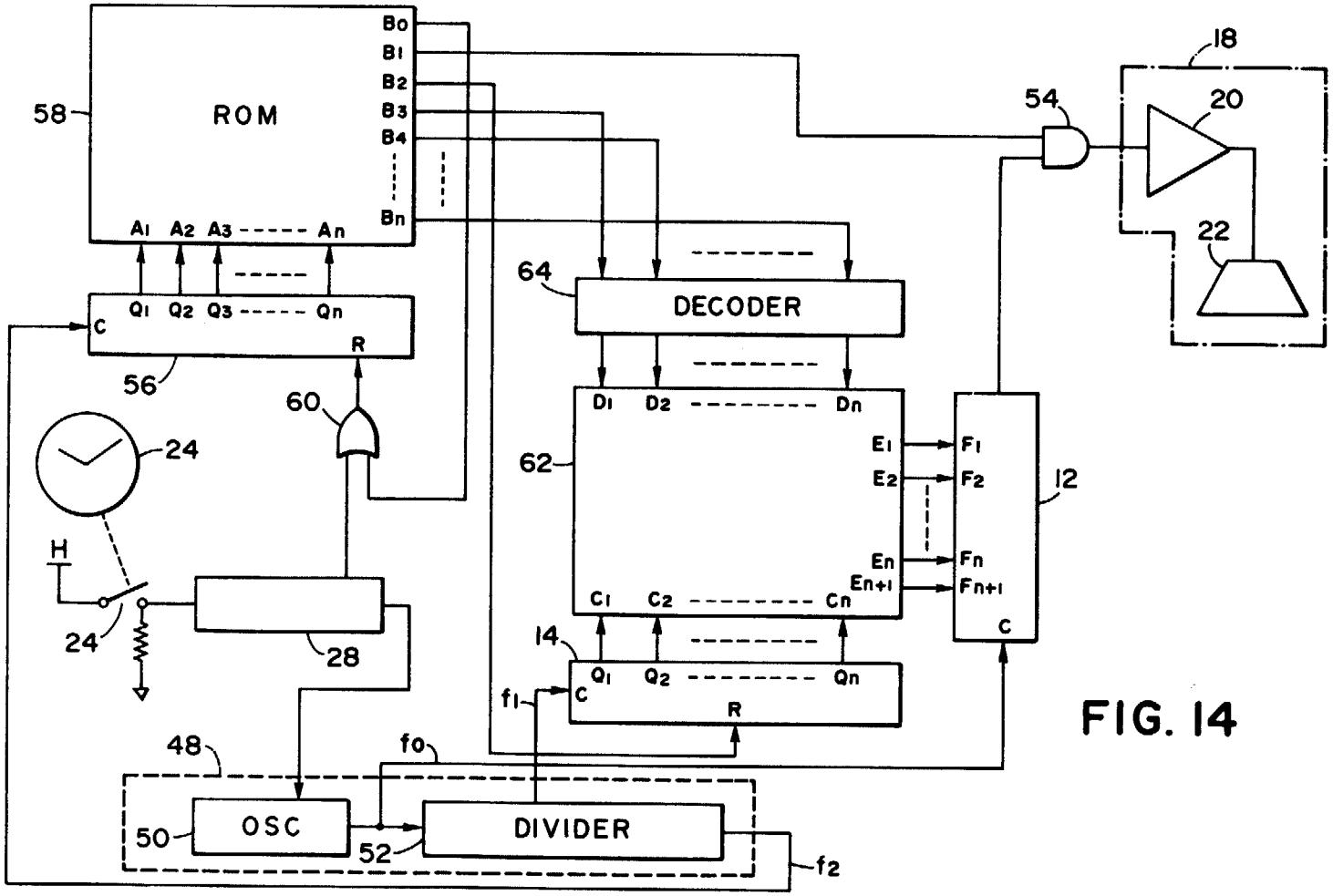
FIG. 14 is a block diagram showing the eighth embodiment of the present invention.

In FIG. 14 shown therein is the eighth embodiment of the present invention.

In the eighth embodiment, the desired onomatopoetic sounds of birds or insects can be obtained by means of changing basic note frequencies of the generating sounds and arranging cut-off period between each of the sounds. The like elements are denoted like referenced numerals with the previous embodiments, and the description will be omitted.

The base signal generating circuit is shown as 48 and composed of the oscillating circuit 50 and the dividing circuit 52 which properly divides the base frequency signals f0 from the oscillating circuit 50 to output the base frequency signals f1 and f2. The strength of the base frequency signals f0, f1 and f2 has the relation of f0 f1 f2. This base signal generator 48 combines the sound base signal generator 10 and the divider 30 mentioned in the previous embodiments.

The base frequency signal f0 is applied to the clock input C of the program divider 12, and the sound signals from divider 12 is applied to the sound producer 18 which is composed of the amplifying circuit 20 and the speaker 22 by way of the AND gate 54.

The base frequency signal f2 from the dividing circuit 52 is applied to the clock input C of the address counter 56. The outputs Q1, Q2, ———, Qn of the address counter 56 are applied to the inputs A1, A2, ———, An of the ROM 58 which includes the basic note memory circuit and the cut-off period memory circuit. In the ROM 58, memorized therein are the data which determine the cut-off period of the signalling sounds, the basic note frequency of the signalling sounds and the repeating cycles of the signalling sounds. The address counter 56 is composed to count the base frequency signal f2 in order to address the ROM based on its counted value and to output the memorized data therein from its outputs B0, B1, B2, B3, B4, ———, Bn. Among the plural outputs of the ROM 58 the data determining the repeating cycle of the signalling sounds is output from the output B0 and applied to the reset input R of the address counter 56 by way of the OR gate 60. From the output B1 the data determining the cut-off period of the signalling sounds is output to be applied to the other input of the AND gate 54, which controls on and off action of the AND gate 54. From the output B2 the data setting the signalling sound frequency signals into the base note frequency is output to be applied to the reset input R of the dividing ratio selecting counter 14. The dividing ratio selecting counter 14 again counts the base frequency signal f1 supplied from the half way stage of the divider 52 when it is reset, and the counted value is applied to the one inputs C1, C2, ———, Cn of the processing circuit 62 by way of the outputs Q1, Q2, ———, Qn. To the other inputs D1, D2, ———, Dn of the processing circuit the signals from the outputs B3, B4, ———, Bn of the ROM 58 are applied. From these outputs B3, B4, ———, Bn are output the data determining the base note frequency signals of the signalling sounds. The processing circuit 62 processes the inputs C1, C2, ———, Cn and inputs D1, D2, ———, Dn to apply to the inputs F1, F2, ———, Fn, Fn+1 of the program divider 12 of way of the outputs E1, E2, ———, En, En+1. The program divider 12 determines the dividing ratio in accordance with the data applied to the inputs F1, F2, ———, Fn, Fn+1.

Figure 15:
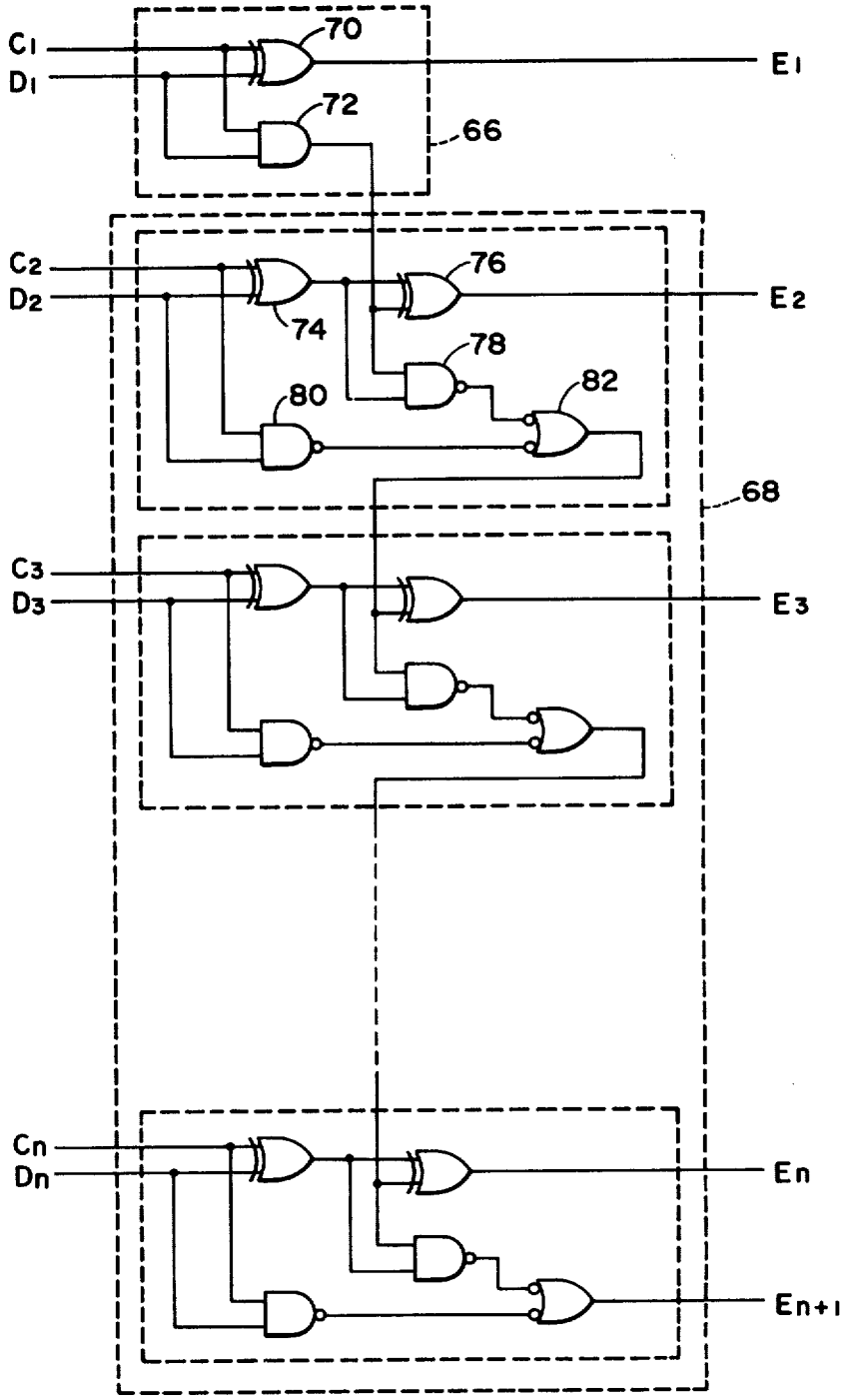
FIG. 15 is a detailed illustration of the processing circuit in FIG. 14.

FIG. 15 shows the detailed circuit diagram of the processing circuit 62 in FIG. 14. In this embodiment, the processing circuit 62 is composed of the adding circuit. In FIG. 15, the processing circuit 62 is composed of one unit of half adder 66 and n−1 units of full adder 68. The half adder 66 is composed of the exclusive OR gate 70 and the AND gate 72. To the inputs of the exclusive OR gate and the AND gate 72 applied are the input signals C1 and D1, and the output signals of the exclusive OR gate 70 is fed to the output E1. Each of the full adder 68 is composed of the exclusive OR gates 74 and 76, the NAND gates 78 and 80, and the OR gate 82. To the one inputs of the exclusive OR gates 74 and the NAND gates 80 applied is each of the input signals C2, C3, ———, Cn and to the other inputs applied is each input signals D2, D3, ———, Dn. The output signals of the exclusive OR gates 74 are applied to the one inputs of the exclusive OR gates 76 and the NAND gates 78. To the other inputs of the exclusive OR gates 76 and the NAND gates 78 applied are the output signals from the OR gates 82 of the lower digit full adder 68 or the AND gate 72 of the half adder 66. The output signals of the exclusive OR gates 76 are respectively output to E2, E3, ———, En. The output signals of the NAND gates 78 and 80 are together applied to the OR gates 82. The output signals from OR gates 82 of the full adder which supplies the outputs En are provided to the output En+1.

FIG. 16 shows the truth table of the half adder 66 illustrated in FIG. 15, and FIG. 18 shows the truth table of the full adder 78 illustrated in FIG. 16. In FIG. 16 C and D show the input signals fed at the inputs of the processing circuit 62 at the inputs C1 and D1. E shows the output signal from the output E1. X shows the output signal of the AND gate 72, that is, the figure-taken-up outputs, and Y shows the figure-taken-up signals fed from the OR gates of the lower digit full adder 68 or the AND gate 72 of the half adder 66.

As evident from the truth tables in FIGS. 16 and 17, the binary digit data applied to the inputs C1, C2, ———, Cn and D1, D2, ———, Dn of the processing circuit 62 by the n−1 units of the full adder 68 are added to each of the figures at the same time, and the added values are fed to the outputs E1, E2, ———, En, En+1.

Figure 19:
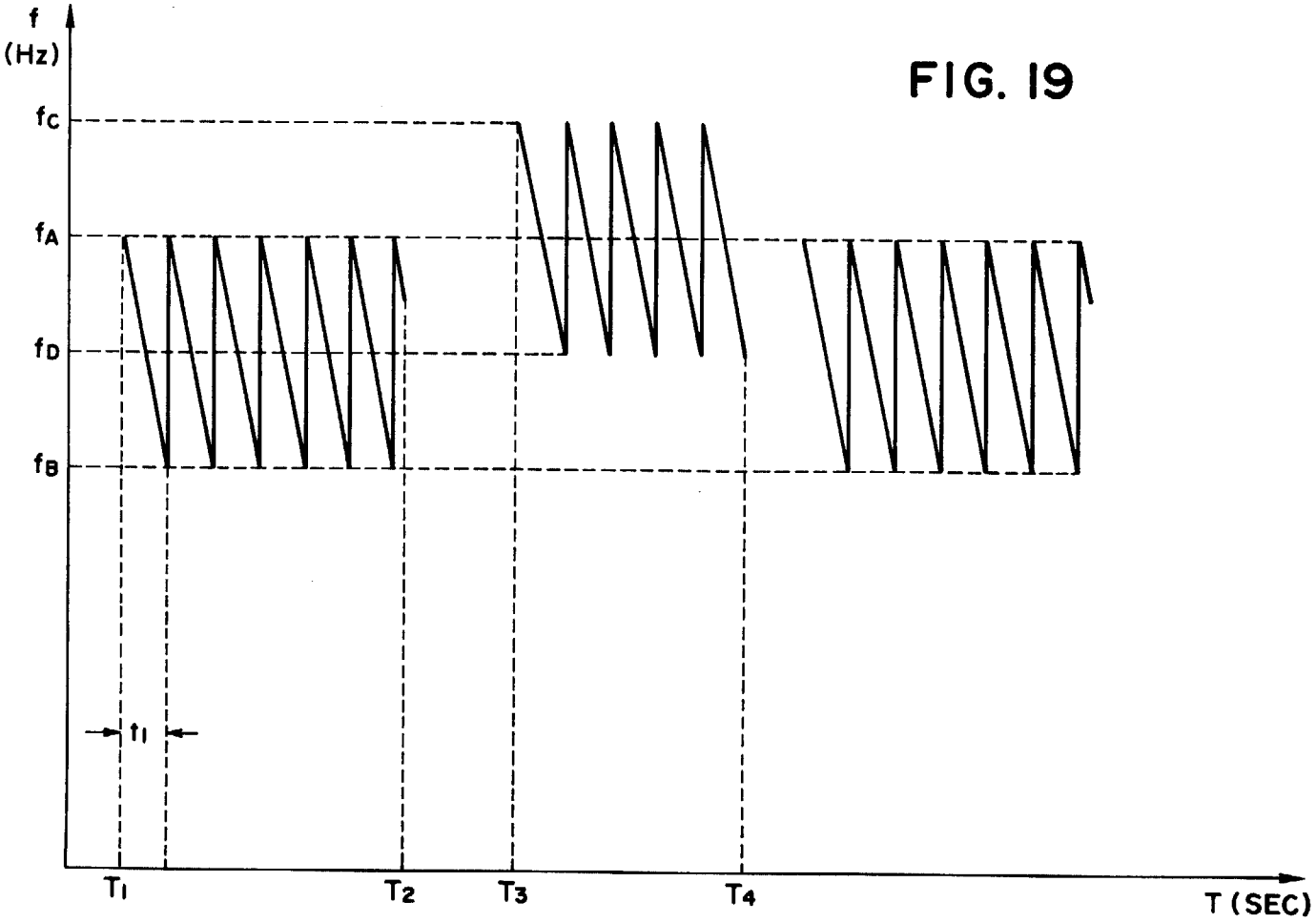
FIG. 19 is a wave form chart showing changes of sound signalling frequencies in accordance with the data shown in FIG. 18.

FIG. 18 is the table showing the contents of the data being fed out from the outputs B0, B1, B2, and FIG. 19 is the wave form chart showing the change of the signalling sound frequencies by the data shown in FIG. 18.

The operation of the circuit diagram in FIG. 14 is hereunder described in reference to the table in FIG. 18 and the wave form chart in FIG. 19. When the preset time comes, the alarm contact points 26 built in the timepiece 24 is closed, and the signal which has been applied from the control circuit 28 to the reset input R of the address counter 56 by way of the OR gate 60 becomes "0" from "1" to release the reset state. The signal "1" is also applied from the control circuit 28 to the oscillating circuit 50 to start the operation of the oscillating circuit 50. The address counter 56 counts the base frequency signal f2 supplied from the base signal generating circuit 48, and when this counted value addresses "1" of the ROM 58, the output signals B1 and B2 become "1", and the output signal B0 becomes "0" (which corresponds with T1 in FIG. 19). At this time the AND gate 54 opens, and the counted contents of the dividing ratio selecting counter 14 are cleared. The dividing ratio selecting counter 14 starts counting the base frequency signal f1 to apply the counted value to the processing circuit 62. The processing circuit 62 adds up the counted value from the dividing ratio selecting counter 14 and the data which determine the signalling sound base note frequency signals supplied from the outputs B3, B4, ———, Bn of the ROM 58 which are applied by way if the decoder 64, and this added value is applied to the inputs F1, F2, ———, Fn, Fn+1 of the program divider 12. The program divider 12 determines the dividing ratio in accordance with the added value supplied from the processing circuit 62, and divides the base frequency signal f0 from the base signal generating circuit 48 until fA as shown in FIG. 19. After this, the counted value of the dividing ratio selecting counter 14 increases as the time elapses, and the added value applied from the processing circuit 62 to the program divider 12 also increases. Accordingly, the dividing ratio of the program divider 12 increases and the signalling sound frequency fed from the program divider 12 decreases. After t1 time elapses, furthermore, the signalling sound frequency goes down to fB, and the count value of the dividing ratio selecting counter 14 returns to "0" again. Accordingly, the dividing ratio of the program divider 12 decreases and the signalling sound frequency increases until fA, since the added value from the processing circuit 62 suddenly decreases. Afterwards, the signalling sound frequency suddenly changes from fA to fB and fB to fA everytime t1 time elapses.

When the counted value of the address counter 56 addresses "5" of the ROM 58, the outputs B0, B1, and B2 of the ROM become "0" altogether (which corresponds to T2 in FIG. 19). This action closes the AND gate 54 to stop the signalling sounds. Further from this state the address counter counts to address "7" of the ROM 58. The output B0 of the ROM 58 becomes "0", and the outputs of B1 and B2 become "1" (which corresponds to T3 in FIG. 19). This action opens the AND gate 54 to clear the dividing ratio selecting counter 14, and it starts counting again from the beginning. The counted value of the dividing ratio selecting counter 14 and the data signals from the outputs B3, B4, ———, Bn of the ROM 58 are added at the processing circuit 62, and this added value is applied to the program divider 12 to determine the dividing ratio. The data of the outputs memorized in the address "7" of the ROM 58 is different from the dividing ratio of the program divider 12 since it is different from the one memorized in the address "1". Because of this, the signalling sound frequency fed from the program divider 12 becomes fC as shown in FIG. 19. As the counted value of the dividing ratio selecting counter 14 increases the signalling sound frequency decreases. As described hereinabove, everytime t1 time elapses and the signalling sound frequencies lowers until fD, the counted contents of the dividing ratio selecting counter 14 return to the beginning, and the signalling sound frequency suddenly increases up to fC.

When the address counter 56 is further counted to address "B" of the ROM 58, the output B0 of the ROM 58 becomes "1", and the outputs B1 and B2 becomes "0" (which corresponds to T4 in FIG. 19). This action resets the address counter 56 to clear the counted contents of the address counter 56, and addresses "0" of the ROM 58. Consequently, the outputs B0, B1 and B2 of the ROM 58 become "0" altogether to close the AND gate 54, and the signalling sounds stop. The address counter 56 again counts the base frequency signal f0, and repeats the above mentioned actions.

As mentioned hereinabove, according to this embodiment, the dividing ratio of the program divider 12 is continuously changed at short interval, and the data of the base note frequencies of bird chirp, etc. memorized in the ROM 58 and the cut-off period changes the base note frequencies, and sets the cut-off period so that the onomatopoetic sounds of birds, etc. can be produced. The circuit in accordance with this embodiment is simple and low in the cost, and it is easy to integrate the circuits since it is composed of complete digital type electronic circuits.

The above described embodiments are built in the alarm clock and the alarm signal is supplied to the control circuit 28, but it is possible that the present invention is used with the time signalling timepiece. It is preferred that the onomatopoetic sounds mentioned above perform the desired time signalling action at each of the right hours or the background sounds in time signalling by means of supplying time signalling signals. In the embodiments, the analog type clock is illustrated as clock mechanisn 24, but it is possible to use the digital type clock or the like.

As described heretofore, according to the present invention, it becomes possible to produce onomatopoetic sounds of bird chirp, insect chirr, etc. with simple composition, and the alarm sounds, time signalling sounds and the like can be played with soft and soothing tones for the users.

What we claim is:

1. A sound generating circuit for a timepiece comprising:

a sound base signal generator which feeds out sound base signals having a certain frequency;

a programmable divider with a plurality of different selectable dividing ratios, and which divides said sound base signals at a desired dividing ratio to output sound signals, said divider being responsive to a dividing ratio selecting counter;

a sound interval generator which feeds out first sound interval base signals and second sound interval base signals;

said dividing ratio selecting counter being composed of:

a repeating cycle counter which repeatedly counts said second sound interval base signals in order to determine the maximum dividing ratio of said programmable divider in accordance with the count value of the repeating cycle counter; and a programmable counter which determines the dividing ratio of said programmable divider from maximum to minimum, and determines sound intervals by means of counting the first sound interval base signals, said maximum dividing ratio is determined by presetting the count value of said repeating cycle counter, and said minimum dividing ratio is determined by the instantaneous count value of the programmable counter when said programmable counter is counted up; and a sound producer which drives sounding elements in accordance with the sound signals of said programmable divider;

whereby sounding action is performed by decreasing the frequency of said sound signals from maximum to minimum by means of increasing the dividing ratio of said programmable divider and changing the frequency of said sound signals from minimum to maximum when said frequency reaches minimum frequency by means of changing the dividing ratio of said programmable divider, said sounding action being performed cyclically and repeatedly.

2. A sound generating circuit for a timepiece according to claim 1, wherein said sound interval base signal generator is composed of a divider which divides sound base signals to feed out sound interval base signals.

3. A sound generating circuit for a timepiece according to claim 1, wherein said sound interval base signal generator is composed of a memory means for storing a predetermined program and a sound interval program divider which changes and controls the frequency of the sound interval base signals in accordance with the predetermined program.

4. A sound generating circuit for a timepiece according to claim 1, wherein attached are:

a base note memory circuit memorizing signals which at least determine the base not frequencies of signalling sounds;

an address counter which addresses the contents of said memory circuit in accordance with the sound base signals supplied from said sound base signal generator; and a processing circuit which processes the counted output of said dividing ratio selecting counter and the output signals from said memory circuit, and feeds out to said program divider;

whereby basic frequencies which repeatedly vary at the sound intervals are changed.

5. A sound generating circuit for a timepiece according to claim 1, wherein dividing ratio change over switches are installed between said program divider and said dividing ratio selecting counter, and optionally alter the combined outputs of dividing ratio selecting signals to establish the desired dividing ratio selecting order.

6. A sound generating circuit for a timepiece according to claim 5, wherein said dividing ratio change over switches switch at least one pair of regular and inverted outputs of said dividing ratio selecting counter.

7. A sound generating circuit for a timepiece according to claim 5, wherein said dividing ratio change over switch is composed of the switch which changes over at least two outputs of said dividing ratio selecting counter to each other.

8. A sound generating circuit for a timepiece according to claim 5, wherein said dividing ratio change over switch changes over a fixed terminal and an output of said dividing ratio selecting counter which corresponds at least to one input of said program divider.

9. A sound generating circuit for a timepiece according to claim 1, wherein attached are:

a cut-off period memory circuit memorizing the signals which at least determine the cut-off period of the signalling sounds;

an address counter which addresses the contents of said memory circuit in accordance with the sound base signals supplied from said sound interval signal generator; and a gate circuit which prevents the output signals from said program divider from being applied to the sound producer by the signals from said memory circuit;

whereby the sounding action of frequencies which repeatedly change at sound intervals is cut off for certain period.

* * * * *